United States Patent [19]

Theurer

[11] Patent Number: 4,799,430

[45] Date of Patent: Jan. 24, 1989

[54] MOBILE BALLAST CLEANING APPARATUS

[75] Inventor: Josef Theurer, Vienna, Austria

[73] Assignee: Franz Plasser Bahnbaumaschinen-Industriegesellschaft m.b.H., Vienna, Austria

[21] Appl. No.: 13,709

[22] Filed: Feb. 12, 1987

[30] Foreign Application Priority Data

Apr. 2, 1986 [EP] European Pat. Off. ..... 86890086.1

[51] Int. Cl.[4] ..... E01B 27/00

[52] U.S. Cl. ..... 104/2; 171/16; 37/107

[58] Field of Search ..... 171/16; 37/104, 107; 104/2, 12, 7.1, 7.2, 279

[56] References Cited

U.S. PATENT DOCUMENTS

| | | | |
|---|---|---|---|
| 1,418,402 | 6/1922 | Scott | 37/104 |
| 4,257,331 | 3/1981 | Theurer et al. | 104/2 |
| 4,479,439 | 10/1984 | Theurer et al. | 104/12 X |
| 4,538,687 | 9/1985 | Theurer et al. | 171/16 |
| 4,576,538 | 3/1986 | Theurer et al. | 104/2 X |
| 4,614,238 | 9/1986 | Theurer et al. | 171/16 |

FOREIGN PATENT DOCUMENTS

| | | | |
|---|---|---|---|
| 1157637 | 11/1963 | Fed. Rep. of Germany . | |
| 3223350 | 1/1984 | Fed. Rep. of Germany . | |
| 1014140 | 5/1952 | France . | |
| 651870 | 10/1985 | Switzerland . | |
| 970010 | 9/1964 | United Kingdom | 37/104 UX |
| 2151676 | 7/1985 | United Kingdom . | |

*Primary Examiner*—Richard J. Johnson

*Assistant Examiner*—Samuel Rimell

*Attorney, Agent, or Firm*—Kurt Kelman

[57] ABSTRACT

A mobile ballast cleaning apparatus comprises a first and a second work vehicle. A track lifting device and a vertically adjustable ballast excavating and conveying chain are mounted on the first work vehicle, and a ballast screening installation for separating waste from cleaned ballast and a waste conveyor means for removing the waste are mounted on the second work vehicle. The apparatus further comprises a cleaned ballast conveying and redistributing installation including a conveyor band mounted on the second vehicle for receiving the cleaned ballast from the ballast screening installation, a first cleaned ballast conveyor arranged to convey the cleaned ballast to an output end adjacent a first ballast redistributing outlet immediately rearwardly of the ballast excavating site, and a second cleaned ballast conveyor having an input end adjacent the output end of the first ballast conveyor and leading to a second ballast redistributing outlet arranged rearwardly of the rear undercarriage of the first work vehicle. A ballast flow deflector is mounted between the output end of the first cleaned ballast conveyor and the input end of the second cleaned ballast conveyor, and a drive selectively positions the ballast flow deflector for directing the cleaned ballast to the first outlet for continuously forming a first layer of cleaned ballast as the mobile apparatus advances in the operating direction and/or to the second outlet for forming a second layer of cleaned ballast over the first layer.

11 Claims, 2 Drawing Sheets

MOBILE BALLAST CLEANING APPARATUS

The present invention relates to a mobile ballast cleaning apparatus mounted for mobility in an operating direction on a track supported on ballast, which comprises a first work vehicle having a front undercarriage and a rear undercarriage mounting the vehicle on the track, a track lifting device mounted on the first work vehicle between the undercarriages, and a vertically adjustable ballast excavating and conveying chain mounted on the first work vehicle at a ballast excavating site between the undercarriages adjacent the track lifting device, a second work vehicle preceding the first work vehicle in the operating direction, a ballast screening installation mounted on the second work vehicle for separating waste from cleaned ballast, and a waste conveyor means mounted on the second work vehicle for removing the waste, a conveyor means for conveying the excavated ballast from the ballast excavating and conveying chain to the ballast screening installation, and a cleaned ballast conveying and redistributing installation for selectively conveying and redistributing cleaned ballast received from the ballast screening installation to a first ballast redistributing outlet immediately rearwardly of the ballast excavating site, and a second ballast redistributing outlet arranged rearwardly thereof for respectively forming a first and a second layer of cleaned ballast.

Swiss Pat. No. 651,870, granted Oct. 15, 1985, discloses such an apparatus wherein the screening installation is comprised of two adjacent screening units. The cleaned ballast conveying and redistributing means of the apparatus comprises a series of successively arranged conveyor bands. A distributing device discharges cleaned ballast through a first outlet immediately rearwardly of the ballast excavating site for forming a first ballast layer on the excavated bed. A ballast redistributing conveyor band is arranged between the distributing device and the rear undercarriage of the first work vehicle, the output end of the ballast redistributing conveyor band constituting a second ballast outlet for forming a second ballast layer over the first layer in the cribs defined between possibly slightly raised ties. The ballast distributing device has a pivotal distributing element enabling a predetermined amount of the cleaned ballast to be distributed to the first ballast outlet and to direct the remainder of the cleaned ballast to the second outlet. This apparatus has the disadvantage that, due to the greatly varying amounts of cleaned ballast received from the screening installation from excavated ballast containing greatly varying amounts of waste, it forms the second layer of cleaned ballast in greatly varying thicknesses, or the entire remainder of the cleaned ballast is discharged through the second outlet or is directed by the pivotal distributing element entirely to the shoulders of the track. Furthermore, the second cleaned ballast outlet is located in the track section which is, even if only slightly, raised above the desired level by the track lifting device whereby cleaned ballast may penetrate uncontrollably into the air gap between the raised tie and the first cleaned ballast layer, which may cause the track to assume an irregular level. It is impossible to avoid the formation of irregular accumulations or voids of ballast, and the resultant grade irregularities cannot be eliminated by subsequent ballast planing devices.

U.S. Pat. No. 4,257,331, dated Mar. 24, 1981, discloses a mobile track surfacing machine wherewith the ballast is cleaned and the ballast bed is subsequently compacted. The machine comprises a first work vehicle constituted by a ballast cleaning machine with a ballast excavating and conveying chain, a ballast screen and associated conveyor bands, and a succeeding second work vehicle constituted by a ballast compacting machine with a crib ballast compacting device. A cleaned ballast outlet is arranged forwardly of the rear undercarriage of the first work vehicle for forming a layer of cleaned ballast on the excavated track bed. To obtain an acceptable redistribution of the cleaned ballast, an extensive ballast plow arrangement without a lifting device for the track is positioned ahead of the ballast compacting device. In one embodiment, the crib ballast compacting device on the second work vehicle is preceded by a track leveling and lining unit in the operating direction and a second cleaned ballast outlet arranged immediately rearwardly of the front undercarriage of the second work vehicle receives cleaned ballast from a conveyor means and is constituted by adjustable discharge openings of a ballast storage container. The cleaned ballast is conveyed from the ballast screen on the first work vehicle to the second cleaned ballast outlet by a ballast redistributing installation comprised of conveyor bands. The crib ballast compacting device consists of pairs of spreadable thrust tamping tools for immersion in the cribs.

U.S. Pat. No. 4,538,687, dated Sept. 3, 1985, also discloses a mobile ballast cleaning apparatus comprising two work vehicles coupled together. The rear vehicle is a ballast cleaning machine with a ballast excavating and conveying chain, a track lifting device and a screening arrangement receiving the excavated ballast from the chain. A pivotal cleaned ballast discharge conveyor band is arranged under the screening arrangement for conveying and redistributing the cleaned ballast immediately rearwardly of the ballast excavating site. The ballast cleaning machine is preceded in the operating direction by a continuously advancing track tamper carrying an operating unit carrying a track leveling and lining device and a ballast tamping device, a carrier frame of the operating unit being cyclically displaceable from tie to tie. This apparatus enables a relatively shallow ballast bed to be cleaned without subjecting the track rails to an unacceptably high upward bending when the ballast excavating and conveying chain is placed in the ballast under the track by tamping only every second or third tie of the track with the track tamper before the rear vehicle. A ballast planing and compacting apparatus is provided behind the ballast discharge site.

Finally, U.S. patent application Ser. No. 655,766, filed Oct. 1, 1984, which corresponds to UK patent application No. 2,151,676 A, published July 24, 1985, discloses a mobile ballast cleaning machine comprising a first work vehicle on which a ballast excavating and conveying chain is mounted between the two undercarriages of the vehicle and a second work vehicle succeeding the same in the operating direction and carrying a screening installation receiving the excavated ballast. A cleaned ballast redistributing means comprising a succession of conveyor bands leading to a first ballast outlet immediately behind the ballast excavating site and a second ballast outlet immediately forwardly of the rear undercarriage of the first work vehicle. The first ballast outlet provides a first cleaned ballast layer on the excavated track bed and the second ballast outlet enables a second ballast layer to be placed over the first ballast layer in the range of the cribs before the track is subjected o any load by the undercarriages. The screening installation comprises two sets of vibratory screens extending obliquely with respect to the track in the direction of elongation of the machine, the sets of screens being arranged sequentially in, and symmetrically with respect to a vertical plane extending transversely to, this direction and having a common inlet receiving the excavated ballast from the chain at a respective upper end of each set of screens, and the obliquely extending screens descending from the respective upper ends to two separate ballast discharges. The cleaned ballast redistributing means is arranged between the screening installation and the two ballast outlets on the first work vehicle which also carries an intermediate ballast storage container at the rear end thereof. In this apparatus, too, the cleaned ballast is discharged exclusively before the track is subjected to any load.

It is the primary object of this invention to improve a mobile ballast cleaning apparatus of the type described in the opening paragraph of this specification by assuring a denser redistribution of the cleaned ballast to provide a more accurate positioning of the track supported thereon, the cleaned ballast being deposited sufficiently uniformly and at the right points to provide such conditions for the subsequent tie tamping operation that the tamped track is ready o sustain train traffic at relatively high speeds.

In such a mobile ballast cleaning apparatus, the above and other objects are accomplished according to the invention with a cleaned ballast conveying and redistributing installation including a conveyor band mounted on the second work vehicle for receiving the cleaned ballast from the ballast screening installation, a first cleaned ballast conveying and redistributing means arranged to convey the cleaned ballast to an output end adjacent a first ballast redistributing outlet immediately rearwardly of the ballast excavating site, and a second cleaned ballast conveying and redistributing means having an input end adjacent the output end of the first ballast conveying and redistributing means and leading to a second ballast redistributing outlet arranged rearwardly of the rear undercarriage of the first work vehicle. A ballast flow deflector is mounted between the output end of the first cleaned ballast conveying and redistributing means and the input end of the second cleaned ballast conveying and redistributing means, and a drive is provided for selectively positioning the ballast flow deflector for directing the cleaned ballast solely to the first outlet for continuously forming a first layer of cleaned ballast as the mobile apparatus advances in the operating direction, solely to the second outlet for forming a second layer of cleaned ballast over the first layer, and into both outlets for simultaneously forming the first and second layers of cleaned ballast.

Preferably, the cleaned ballast conveying and redistributing installation includes a third cleaned ballast conveying and redistributing means having an input end adjacent an output end of the second cleaned ballast conveying and redistributing means for conveying excess cleaned ballast, for example to a succeeding freight car.

Such a cleaned ballast conveying and redistributing installation enables the cleaned ballast to be discharged simultaneously or selectively through the first and second ballast outlet, as well as any excess cleaned ballast to be transported away, thus providing a uniform first ballast layer and a uniform second ballast layer in the cribs, regardless of the varying output of cleaned ballast from the screening installation. The arrangement of the second ballast redistributing outlet rearwardly of the rear undercarriage of the first work vehicle enables this undercarriage to subject the track to a load so that the track will rest with its ties in solid contact on the ballast before ballast is discharged into the cribs through the second outlet. In this way, a continuously uniform first ballast layer of any uniform selected depth and a second ballast layer in the cribs may be provided before the ties are tamped. This provides a very advantageous ballast condition for the subsequent tamping operation because the cleaned ballast bed will have a constant depth and great uniformity of density. The tamping may be effected shortly after the cleaned ballast has been redistributed and independently of the cleaned ballast redistribution, or it may be effected in a single operating stage simultaneously with the cleaned ballast redistribution.

The above and other objects, advantages and features of the present invention will become more apparent from the following detailed description of certain now preferred embodiments thereof, taken in conjunction with the generally schematic drawing wherein FIG. 1 is a side elevational view showing the front section of a mobile ballast cleaning apparatus according to this invention;

Figures 1, 2, 3, 4:
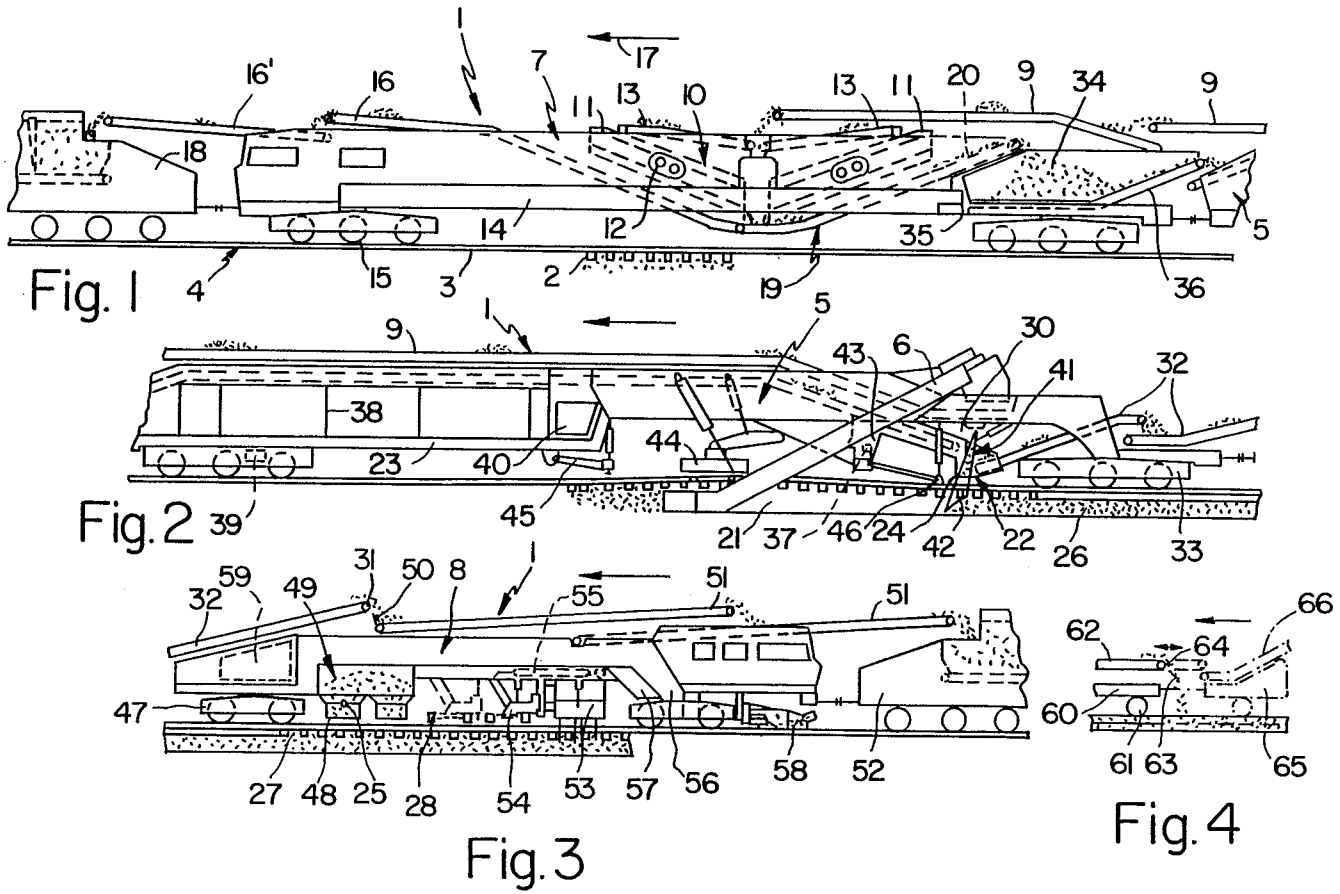
FIG. 2 is a like view showing the intermediate section of the apparatus.
FIG. 3 is a like view showing the rear section of the apparatus.
FIG. 4 is a fragmentary, highly simplified view of a modification of the cleaned ballast conveying and redistributing installation at the second outlet.

Referring now to the drawing and first to FIGS. 1–3, 5 and 6, there is shown mobile ballast cleaning apparatus 1 mounted for mobility in an operating direction indicated by arrow 17 on track 4 consisting of rails 3 fastened to ties 2 supported on ballast. This apparatus comprises first work vehicle 5 having a front undercarriage provided with drive 39 and rear undercarriage 33 mounting the vehicle on the track. Track lifting device 44 is mounted on work vehicle 5 between the undercarriages and vertically adjustable ballast excavating and conveying chain 6 is mounted on work vehicle 5 at ballast excavating site 21 between the undercarriages adjacent track lifting device 44. Endless chain 6 is driven in rotation in a guide under track 4 and has excavating fingers for continuously excavating ballast from under the track and conveying the excavated ballast upwardly in the guide. Second work vehicle 7 precedes first work vehicle 5 in the operating direction indicated by arrow 17. Ballast screening installation 10 is mounted on frame 14 of vehicle 7 for separating waste from cleaned ballast and waste conveyor means is mounted on vehicle frame 14 and comprises a waste conveyor band 16 running between undercarriages 15 of vehicle 7 for removing the waste from the screening installation to a short waste discharge conveyor 16' throwing the waste into a car of freight train 18 preceding apparatus 1. The illustrated ballast screening installation comprises two independent screening units 11 each comprised of a set of superimposed screens and independently vibrated by separate drives 12. The two sets of vibratory screens extend obliquely with respect to the track in the direction of elongation of the machine, and the sets of screens are arranged sequentially in, and symmetrically with respect to a vertical plane extending transversely to, this direction. The obliquely extending screens ascend from a centrally located outlet to two separate ballast inlets whereto the excavated ballast is conveyed by two excavated ballast discharge conveyor bands 13 mounted above screening units 11. The ballast screening units have inputs positioned below a discharge end of a conveyor means 9 for conveying the excavated ballast to ballast screening installation 10. The conveyor bands 13 receive the excavated ballast from trough-shaped conveyor bands 9 and convey the excavated ballast to respective screening unit 11. The screening installation is more fully described and claimed in my simultaneously filed U.S. patent application Ser. No. 13,710 entitled "Ballast Cleaning Machine".

Figures 5, 6, 7:
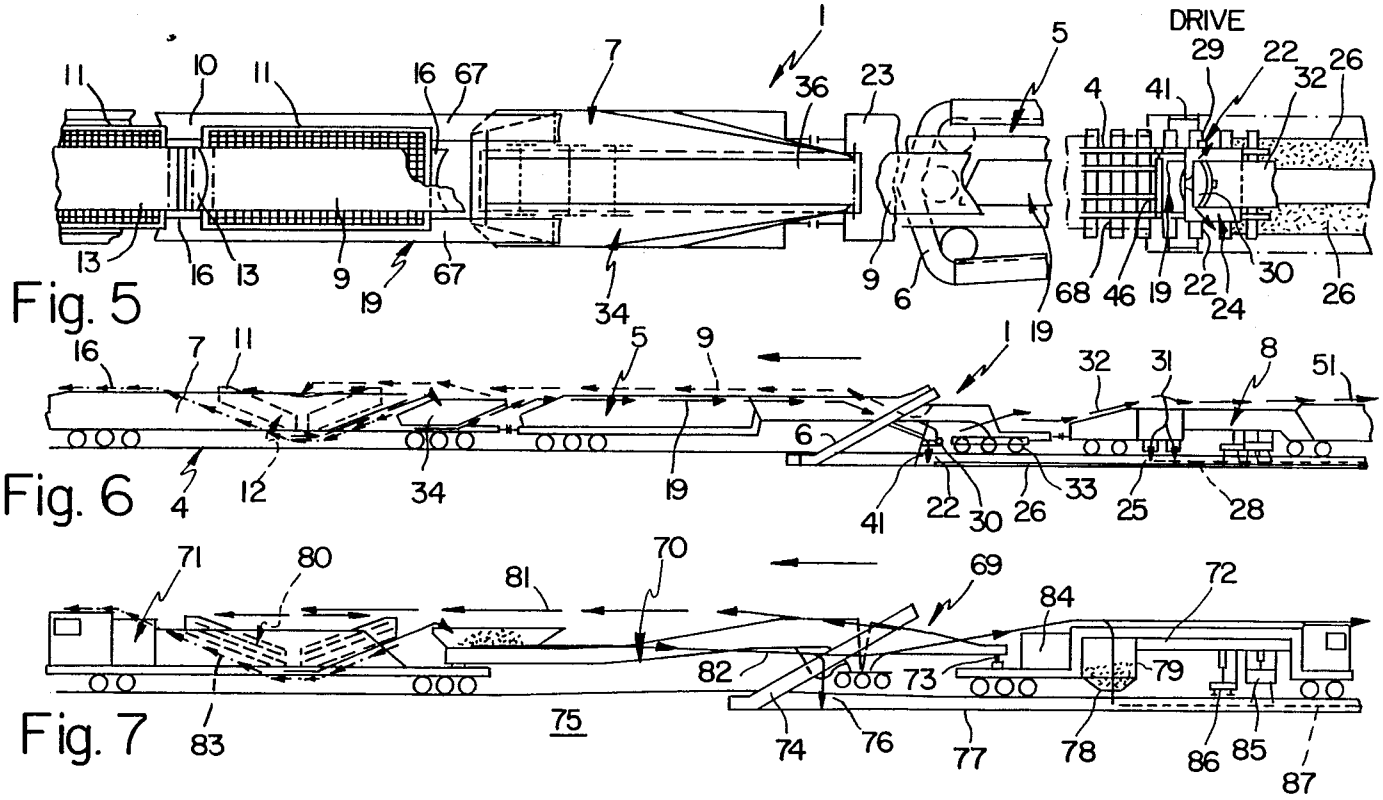
FIG. 5 is a fragmentary top view of the mobile apparatus illustrated in FIGS. 1 to 3.
FIG. 6 is a diagrammatic total side view of the mobile apparatus of FIGS. 1 to 3, showing the first, second and third work vehicles, the conveying paths of the ballast and waste components being indicated by arrows to clarify the operation.
FIG. 7 is a like view of another embodiment of the mobile ballast cleaning apparatus of the invention.

The cleaned ballast is redistributed by cleaned ballast conveying and redistributing installation 19 which includes conveyor band means 20 mounted on second work vehicle 7 for receiving the cleaned ballast from ballast screening installation 10 As shown in FIG. 5, conveyor band means 20 of the illustrated embodiment comprises two parallel, trough-shaped cleaned ballast collecting conveyor bands 67. Installation 19 further comprises a first cleaned ballast conveying and redistributing means comprised of successive conveyor bands and arranged to convey the cleaned ballast to an output end adjacent first ballast redistributing outlet 22 immediately rearwardly of ballast excavating site 21, and second cleaned ballast conveying and redistributing means 32 comprised of a succession of conveyor bands having an input end adjacent the output end of the first ballast conveying and redistributing means and leading to second ballast redistributing outlet 25 rearwardly of rear undercarriage 33 of first work vehicle 5. First ballast redistributing outlet 22 is constituted by ballast redistributing chute 24 mounted on frame 23 of vehicle 5 and having ballast discharge openings arranged between track rails 3 and at respective opposite ends of ties 2. Ballast flow deflector 30 is mounted between the output end of the first cleaned ballast conveying and redistributing means and the input end of second cleaned ballast conveying and redistributing means 32, and drive 29 (see FIG. 5) selectively positions ballast flow deflector 30 for directing the cleaned ballast solely to first outlet 22 for continuously forming first layer 26 of cleaned ballast as mobile apparatus 1 advanced in the operating direction indicated by arrow 17, solely to second outlet 25 for forming second layer 28 of cleaned ballast over the first layer in cribs 27, and to both outlets 22 and 25 for simultaneously forming first and second layers 26 and 28 of cleaned ballast. Cleaned ballast conveying and redistributing installation 19 further includes third cleaned ballast conveying and redistributing means 51 having an input end adjacent output end 31 of second cleaned ballast conveying and redistributing means 32 for conveying excess cleaned ballast to a succeeding freight train 52.

The second cleaned ballast conveying and redistributing means shown in FIG. 2 comprises a first endless trough-shaped conveyor band 32 reaching to rear undercarriage 33 of vehicle 5 and a succeeding second trough-shaped conveyor band 32 projecting therebeyond and having output 31. The output may lead to ballast discharge chutes or may be equipped with ballast flow deflector means providing a readily adjustable second ballast redistributing outlet enabling the cleaned ballast to be redistributed to locations at both sides of each track rail where the ties are supported on the ballast. Such an arrangement may be readily retrofitted on existing ballast cleaning machines.

The illustrated mobile ballast cleaning apparatus further comprises third work vehicle 8 having front undercarriage 47 and a rear undercarriage mounting the vehicle on track 4. The third work vehicle is arranged rearwardly of first work vehicle 5 in the operating direction and second ballast redistributing outlet 25 is arranged rearwardly of front undercarriage 47 of third work vehicle 8. Ballast storage container 49 is mounted on the third work vehicle for receiving the cleaned ballast from second ballast conveying and redistributing means 32 and the ballast storage container has adjustable ballast outlet means 48 constituting second ballast redistributing outlet 25. A track lifting, lining and tamping unit 53, 54 is displaceably mounted on the third work vehicle for displacement relative to ballast storage container 49. Ballast tamping head 53 and track lifting and lining device 54 are connected to displacement drive 55 for common displacement between the position shown in full lines and the position shown in chain-dotted lines in FIG. 3. As described hereinabove, the second cleaned ballast conveying and redistributing means comprises two successively arranged ballast redistributing conveyor bands 32, the first conveyor band 32 having its input end adjacent the output end of first ballast conveying and redistributing means 9 and second conveyor band 32 having its output end 31 above ballast storage container 49 while third cleaned ballast conveying and redistributing means 51 is mounted on third work vehicle 8 and has an input end adjacent output end 31. Another ballast flow deflector 50 is mounted between output end 31 and the input end of the third cleaned ballast conveying and redistributing means for selectively directing the cleaned ballast to storage container 49 and excess cleaned ballast to the third cleaned ballast conveying and redistributing means.

Providing second cleaned ballast redistributing outlet 25 on a third work vehicle constituting a track leveling, lining and tamping machine enables the tamping operator to control the ballast redistribution so as to assure uniform ballast tamping while the tamping proceeds. Providing an interposed ballast storage container 49 with adjustable discharge openings enables cleaned ballast to be discharged continuously in an even flow, regardless of the varying amounts of cleaned ballast received from screening installation 10. At the same time, any residual cleaned ballast coming from the screening installation and redistributed when the apparatus is stopped for some reason can be stored without causing unwanted accumulations of cleaned ballast on the track bed. Stored cleaned ballast can be used for maintaining a uniform second layer of cleaned ballast in such track sections where the screening installation produces an excess amount of waste and relatively little cleaned ballast. In other words, the ballast may be cleaned and the cleaned ballast may be uniformly redistributed while tamping the ties in a single operating stage to produce a permanent, accurate track positioning. Arranging ballast flow deflector 50 above ballast storage container 49 makes it possible to direct the ballast flow selectively either to outlet 25 or to cleaned ballast removal conveyor bands 51, depending on prevailing requirements. This enables the apparatus to be adapted rapidly to varying ballast conditions and, furthermore, excess ballast can be removed and need not be discharged on the track shoulders, which sometimes is impossible, for example in railroad yards.

As shown in FIG. 1, ballast screening installation 10 is mounted substantially centrally on second work vehicle 7 and cleaned ballast conveying and redistributing installation 19 further includes intermediate ballast storage container 34 receiving the cleaned ballast from conveyor band means 20. Endless conveyor band 36 independently driven by drive 35 receives cleaned ballast from storage container 34 and conveys the same to the first cleaned ballast conveying and redistributing means. Control 37 enables the cleaned ballast to flow selectively to first and/or second cleaned ballast redistributing outlet 22 and/or 25, or excess cleaned ballast to be removed. The intermediate ballast storage container enables both outlets to receive an even amount of cleaned ballast for forming cleaned ballast layers of even depth, regardless of the varying amounts of cleaned ballast coming from the screening installation. The provision of the intermediate ballast storage container is of particular advantage with the use of the two independently operating screening units 11, 11 which have a high screening capacity and discharge the cleaned ballast in a common outlet. Control 37 enables cleaned ballast conveying and redistributing installation 19 with its cleaned ballast flow deflectors to be operated so that only the amount of removed excess cleaned ballast need be changed to assure a constant and uniform flow of cleaned ballast to cleaned ballast redistributing outlets 22 and 25.

As shown in FIG. 2, central power plant 38 is mounted on first work vehicle 5 which also houses operator's cab 40. Furthermore, ballast compacting device 41 is mounted on the first work vehicle adjacent first ballast redistributing outlet 22 for compacting the redistributed cleaned ballast to form first layer 26 of cleaned ballast in a direction opposite the operating direction indicated by arrow 17. The illustrated compacting device comprises beam 42 whose upper end is pivoted to machine frame 23 of vehicle 5 and a drive is connected to the pivotal beam for imparting intermittent impact motions to the beam in the direction of track elongation. A preferred compacting device has been more fully described and claimed in U.S. patent application Ser. No. 13,708 entitled "Mobile Ballast Cleaning Machine with Ballast Compacting device", now U.S. Pat. No. 4,760,796 filed simultaneously by me and Manfred Brunninger. The ballast compacting device enables the discharged mounds of cleaned ballast to be compacted in a direction opposite to the operating direction, preferably in two ballast banks extending below the track rails which are further compacted by the resistance of the track exerting a downward pressure thereon. In this way, the ballast support decisive for providing a permanent track position is subjected to a pre-compaction immediately after the cleaned ballast has been laid on the bed, which is further enhanced by the load of the succeeding undercarriage or undercarriages exerted thereon.

Cleaned ballast conveying and redistributing installation 19 further comprises operator's cab 43 mounted on first work vehicle 5 within sight of excavating site 21 for observing redistributed cleaned ballast at first outlet 22 and control 37 is housed in cab 43 for selectively positioning ballast flow deflector 30. Mounting cab 43 within sight of the ballast excavating site and preferably additional operator's cabs on all work vehicles for monitoring the operation of the various tools enables a constant observation of all operations and an exact control of the desired depth of the layers of cleaned ballast. This may be further controlled by a vertical adjustment of ballast excavating and conveying chain 6.

Vertically adjustable track lifting device 44 is linked to machine frame 23 of vehicle 5 within the range of ballast excavating and conveying chain 6 and auxiliary track lifting device 45 is mounted on the machine frame adjacent thereto to give the track an extra lift for introducing chain 6 therebelow. Furthermore, track depressing device 46 is mounted on the machine frame immediately forwardly of ballast compacting device 41 to press the track against the ballast. The track depressing device comprises a pivotal frame supporting a pair of flanged rollers engaging track rails 3 and a vertically adjustable drive connecting the pivotal frame to machine frame 23 for exerting a downward pressure on the pivotal frame.

As shown in FIG. 3, second ballast redistributing outlet 25 is arranged on third work vehicle 8 immediately rearwardly of front undercarriage 47 thereof and ballast storage container 49 has adjustable outlet openings 48 constituting the second outlet. Ballast storage container 49 is arranged below output end 31 of ballast redistributing conveyor band 32. Ballast flow deflector 50 is mounted between output end 31 and an input end of a first of a series of successive conveyor bands 51 transporting excess cleaned ballast to succeeding freight train 52 upon adjustment of the ballast flow deflector. Rear conveyor band 51 is displaceably mounted on vehicle 8 for extension towards, and retraction from, the freight train. Track lifting and lining unit 54 and tamping unit 53 are displaceably mounted in guides on machine frame 56 of vehicle 8 for common movement by displacement drive 55. Operator's cab 57 and vertically adjustable broom arrangement 58 comprising a rotary broom extending over the entire width of the track and a transversely extending conveyor band receiving swept ballast from the broom are arranged rearwardly of tamping unit 53 on vehicle 8. Power plant 59 provides driving power for the tools of vehicle 8.

It is preferred to arrange a respective one of first and second ballast redistributing outlets 22 and 25 above each track rail 3, the two first ballast redistributing outlets 22 and the two second ballast redistributing outlets 25 being transversely aligned whereby two parallel first and second layers 26 and 28 of cleaned ballast may be formed along the rails. This produces two continuous and parallel ballast supports in the cribs at intersections 68 (see FIG. 5) of the ties and rails. The two transversely aligned first ballast redistributing outlets will form two continuous, parallel cleaned ballast banks under the ties subtending the rails. The ballast banks will be pre-compacted under the load of the track, whereupon a second layer of cleaned ballast will be formed in the cribs from the cleaned ballast discharged through the second outlets in quantities sufficient to provide the ballast needed for a uniform tamping of the ties.

The fragmentary illustration of FIG. 4 shows another embodiment. Only the rear end of first work vehicle 60 supported on rear undercarriage 61 is illustrated. As shown endless conveyor band 62 of the second cleaned ballast conveying and redistributing means has output end 64 constituting second ballast redistributing outlet 63. As shown by the double-headed arrow, endless conveyor band 62 is displaceable in the direction of track elongation for selective movement into the retracted position shown in solid lines, wherein the cleaned ballast is simply projected over output end 64 onto the track bed for laying the second layer of cleaned ballast in the cribs, and into the extended position shown in chain-dotted lines, wherein the cleaned ballast is transferred to succeeding conveyor band 66 on third work vehicle 65 for discharging the cleaned ballast to a second ballast redistributing outlet rearwardly of the front undercarriage of the third work vehicle, as in the embodiment of FIG. 3. Endless conveyor band 62 is preferably trough-shaped. This arrangement enables the apparatus to be used selectively either to discharge the cleaned ballast through a second outlet directly behind the rear undercarriage of the first work vehicle or, simply by displacement of conveyor band 62, to connect to a second cleaned ballast redistributing outlet behind the front undercarriage of a track leveling, lining and tamping machine coupled to the ballast cleaning machine. The displaceable conveyor band may be retrofitted on existing ballast cleaning machines with a minimum of expense.

As the top view of mobile ballast cleaning apparatus 1 in FIG. 5 shows, ballast conveying and redistributing installation 19 comprises two parallel, trough-shaped cleaned ballast collecting conveyor bands 67 receiving cleaned ballast from ballast screening installation 10 and extending in the direction of track elongation and transversely spaced from each other. Trough-shaped waste component conveyor band 16 is arranged between conveyor bands 67 for receiving and removing the waste coming from screening installation 10. The drawing also shows the two transversely aligned first cleaned ballast redistributing outlets 22 at the track rails for forming parallel layers 26 of the cleaned ballast.

To enable considerable quantities of ballast as well as waste to be conveyed over substantial distances, all of the conveyor bands, except conveyor band 36 associated with intermediate ballast storage container 34, are trough-shaped or concave in transverse section. This prevents the conveyed ballast or waste to be spilled over machine parts or tools therebelow, which could interfere with the operation of the apparatus.

The arrows in FIG. 6 clearly show the conveyance path of the ballast and waste components. As shown, the ballast excavated and conveyed upwardly by chain 6 is conveyed by conveyor band 9 illustrated by arrows in broken lines to discharge conveyor bands 13 delivering the excavated ballast to the respective inlets of ballast screening units 11. As shown by arrows in solid lines, the cleaned ballast is conveyed in a direction opposite to the operating direction to intermediate ballast storage container 34 on second work vehicle 7 and then to first ballast redistributing outlet 22 on first work vehicle 5, where some of it is discharged on the excavated track bed. The remaining part of the cleaned ballast is further conveyed to second outlet 25 on third work vehicle 8 and any excess cleaned ballast is then removed to the succeeding freight train.

Mobile ballast cleaning apparatus 69 shown in FIG. 7 also comprises a first, intermediate work vehicle 70, a second work vehicle 71 preceding the same and a third work vehicle 72 succeeding the same. The front end of first work vehicle 70 is pivotally supported on the rear end of second work vehicle 71 and vertically adjustable support 73 supports the rear end of the first work vehicle vertically adjustably on the front end of the third work vehicle. The first work vehicle has an undercarriage equipped with a track lifting device arranged immediately rearwardly of vertically adjustable ballast excavating and conveying chain 74. When the apparatus is in the illustrated operating condition, the undercarriage is lifted off track 75 by actuation of vertically adjustable support 73 to raise the rear end of the first work vehicle and when the apparatus is moved on track 4 from one operating site to another, the undercarriage is lowered onto the track so that the first work vehicle runs thereon. First cleaned ballast redistributing outlet 76 forming first layer 77 of cleaned ballast is arranged between ballast excavating and conveying chain 74 and the undercarriage. Second cleaned ballast redistributing outlet 78 is arranged on third work vehicle 72 and is constituted by cleaned ballast storage container 79 having adjustable outlet openings for forming second layer 87 of cleaned ballast filling the cribs. A conveyor band arrangement indicated by solid arrows 81 conveys the excavated ballast to ballast screening installation 80 and cleaned ballast conveying and redistributing installation 82 conveys the cleaned ballast from the screening installation to first and second outlets 76 and 78. A waste removing conveyor band 83 indicated by chain-dotted arrows removes the waste from the screening installation. Third work vehicle 72 has power plant 84 and carries longitudinally displaceable track lifting and lining unit 86 and tamping unit 85.

The operation of the illustrated apparatus will partly be obvious from the preceding description of its structure and will now be set forth in detail.

At the beginning of the ballast cleaning operation, track lifting device 44 and auxiliary track lifting device 45 are actuated to lift track 4 to enable the transverse section of ballast excavating and conveying chain 6 to be placed under the track for excavating the ballast. After the ballast excavating and conveying chain has been properly positioned and vertically adjusted, the operators in cabs 40 and 43 begin the operation of the apparatus. By rotating endless excavating and conveying chain 6, the dirty and encrusted ballast is continuously excavated and conveyed to conveyor band 9 which conveys the excavated ballast forwardly in the operating direction to second work vehicle 7 where it is discharged on delivery conveyor bands 13. These conveyor bands convey the excavated ballast respectively to screening units 11 which are independently vibrated by separate vibrating drives 12. By changing the speed of conveyor band 9, the discharge trajectory of the excavated ballast may be varied so that, for example, more of the excavated ballast, or even all of it, falls on the foreward conveyor band 13. This has the advantage that only one of the screening units 11 may be operated in track sections which have a shallow ballast bed and where, therefore, relatively little ballast is excavated and cleaned. The waste component separated from the ballast by the swinging superposed screens of the screening units falls onto waste removal conveyor band 16 arranged centrally below screening installation 10 and is conveyed in the operating direction to freight train 18 which precedes mobile ballast cleaning apparatus 1.

The cleaned ballast falls onto the two conveyor bands 67 arranged under the screening installation at respective sides thereof and is conveyed to intermediate cleaned ballast storage container 34. Independently of the amount of cleaned ballast coming from screening installation 10, drive 35 of conveyor band 36 is so controlled that sufficient cleaned ballast will always be conveyed from the intermediate cleaned ballast storage container to first and second cleaned ballast redistributing outlets 22 and 25. Depending on the position of ballast flow deflector 30, a portion of the cleaned ballast will be discharged through chute 24 under lifted track 4 on the excavated track bed. The discharged cleaned ballast forms first layer 26 of loose ballast and will be compacted under ties 2 in the direction of track elongation by the continuous impacting movements of beam 42 of ballast compacting device 41. Immediately succeeding in the operating direction, the first layer of cleaned ballast will be further compacted by the track subjected to the load of rear undercarriage 33 of first work vehicle 5.

As will be noted from FIGS. 2 and 3, the cleaned ballast directed by ballast flow deflector 30 to succeeding conveyor band 32 is conveyed in a direction opposite to the operating direction to third work vehicle 8 where it is discharged from output end 31 of conveyor band 32 into cleaned ballast storage container 49 and/or to succeeding conveyor band 51, depending on the position of ballast flow deflector 50. Adjustable outlet openings 48 of storage container 48 redistribute the cleaned ballast at the second outlet 25 to form second layer 28 of cleaned ballast in cribs 27 of track 4. The outlet openings are so adjusted by an operator in cab 57 that a sufficient amount of ballast is available at intersections 68 of the ties and rails to assure a uniform and high-quality tamping of the ties by succeeding tamping unit 53. Any excess ballast determined by the position of ballast flow deflector 50 is conveyed by conveyor bands 51 to succeeding freight train 52.

While mobile ballast cleaning apparatus advances continuously in the operating direction indicated by arrow 17, the cleaned ballast provided by layers 26 and 28 is tamped under ties 2 by cyclically displacing the track lifting and lining unit 54 in common with tamping unit 53 from tie to tie, and operating these units in a conventional manner to correct the position of the track and tamp the ballast under the correctly positioned track. Any ballast remaining on the ties after tamping is swept up by the rotary broom at the rear end of the third vehicle and is conveyed to the shoulders of the track by the transverse conveyor band of broom arrangement 58.

Track depressing device 46 arranged immediately ahead of ballast compacting device 41 prevents track 4 from being uncontrollably raised by the compacting forces of device 41. The vertical adjustment of track depressing device 46 as well as the quantity of cleaned ballast discharged at first outlet 22 are controlled by an operator of central control 37 in cab 43. The positioning of ballast flow deflector 50 is controlled in dependence on the filling state of storage container 49 placed therebelow. As soon as the storage container is full, the ballast flow deflector is forwardly pivoted into the position shown in FIG. 3 so that its free end is aligned with output end 31 of conveyor band 32 so that it forms a chute from this output end to succeeding excess cleaned ballast removing conveyor band 51. As the amount of stored cleaned ballast in container 49 decreases, ballast flow deflector 50 is pivoted rearwardly sufficiently to divert a desired portion of the cleaned ballast to the ballast storage container below it. If relatively little cleaned ballast is delivered at output end 31, ballast flow deflector 50 is pivoted rearwardly to an end position in which all of the cleaned ballast falls into storage container 49.

What is claimed is:

1. A mobile ballast cleaning apparatus mounted for mobility in an operating direction on a track supported on ballast, which comprises (a) a first work vehicle having a front undercarriage and a rear undercarriage mounting the vehicle on the track
  (1) a track lifting device mounted on the first work vehicle between the undercarriages, and
  (2) a vertically adjustable ballast excavating and conveying chain mounted on the first work vehicle at a ballast excavating site between the undercarriage adjacent the track lifting device, (b) a second work vehicle preceding the first work vehicle in the operating direction and having a front undercarriage and a rear undercarriage mounting the vehicle on the track,
  (1) a ballast screening installation mounted substantially centrally on the second work vehicle for separating waste from cleaned ballast, and
  (2) a waste conveyor means mounted on the second work vehicle for removing the waste, (c) a conveyor means for conveying the excavated ballast from the ballast excavating and conveying chain to the ballast screening installation, (d) a cleaned ballast conveying and redistributing installation including a conveyor band mounted on the second work vehicle for receiving the cleaned ballast from the ballast screening installation, a first cleaned ballast conveying and redistributing means arranged to convey the cleaned ballast to an output end adjacent a first ballast redistributing outlet immediately rearwardly of the ballast excavating site, a second cleaned ballast conveying and redistributing means having an input end adjacent the output end of the first ballast conveying and redistributing means and leading to a second ballast redistributing outlet arranged rearwardly of the rear undercarriage of the first work vehicle, and a third cleaned ballast conveying and redistribution means arranged to convey any excess cleaned ballast to a predetermined distribution outlet, (e) a ballast flow deflector mounted between the output end of the first cleaned ballast conveying and redistributing means and the input end of the second cleaned ballast conveying and redistributing means, and (f) a drive for selectively positioning the ballast flow deflector for directing the cleaned ballast solely to the first outlet for continuously forming a first layer of cleaned ballast as the mobile apparatus advances in the operating direction, solely to the second outlet for forming a second layer of cleaned ballast over the first layer, and into both outlets for simultaneously forming the first and second layers of cleaned ballast.

2. The mobile ballast cleaning apparatus of claim 1, wherein said third cleaned ballast conveying and redistributing means has an input end adjacent an output end of the second cleaned ballast conveying and redistributing means for conveying excess cleaned ballast.

3. The mobile ballast cleaning apparatus of claim 1, wherein the second cleaned ballast conveying and redistributing means comprises an endless conveyor band having an output end constituting the second outlet, the endless conveyor band being displaceable in the direction of track elongation.

4. The mobile ballast cleaning apparatus of claim 3, wherein the endless conveyor band is trough-shaped.

5. The mobile ballast cleaning apparatus of claim 1, further comprising a third work vehicle having a front undercarriage and a rear undercarriage mounting the vehicle on the track, the third work vehicle being arranged rearwardly of the first work vehicle in the operating direction and the second ballast redistributing outlet being arranged rearwardly of the front undercarriage of the third work vehicle, a ballast storage container mounted on the third work vehicle for receiving the cleaned ballast from the second ballast conveying and redistributing means, the ballast storage container having adjustable ballast outlet means constituting the second ballast redistributing outlet, and a track lifting, lining and tamping unit displaceably mounted on the third work vehicle for displacement relative to the ballast storage container.

6. The mobile ballast cleaning apparatus of claim 5, wherein the second cleaned ballast conveying and redistributing means comprises two successively arranged ballast redistributing conveyor bands, a first one of said ballast redistributing conveyor bands having said input end adjacent the output end of the first ballast conveying and redistributing means and a second one of said ballast redistributing conveyor bands having an output end above said ballast storage container, and further comprising a third cleaned ballast conveying and redistributing means mounted on the third work vehicle and having an input end adjacent the output end of the second ballast redistributing conveyor band, and another ballast flow deflector mounted between the output end of the second ballast redistributing conveyor and the input end of the third cleaned ballast conveying and redistributing means for selectively directing the cleaned ballast to the ballast storage container and excess cleaned ballast to the third cleaned ballast conveying and redistributing means.

7. The mobile ballast cleaning apparatus of claim 1, further comprising a ballast compacting device mounted on the first work vehicle adjacent the first ballast redistributing outlet for compacting the redistributed cleaned ballast to form the first layer of cleaned ballast in a direction opposite the operating direction.

8. The mobile ballast cleaning apparatus of claim 1, wherein said cleaned ballast conveying and redistributing installation further includes an intermediate ballast storage container receiving the cleaned ballast from the conveyor band and an independently driven endless conveyor band receiving the cleaned ballast from the intermediate ballast storage container and conveying the same to the first cleaned ballast conveying and redistributing means.

9. The mobile ballast cleaning apparatus of claim 8, wherein the ballast screening installation comprises two independent screening units, and the conveyor means for conveying the excavated ballast to the ballast screening installation comprises a trough-shaped conveyor band and a respective additional conveyor band receiving the excavated ballast from the trough-shaped conveyor band and conveying the excavated ballast to a respective one of the screening units.

10. The mobile ballast cleaning apparatus of claim 1, wherein the cleaned ballast conveying and redistributing installation further comprises an operator's cab mounted on the first work vehicle within sight of the excavating site for observing redistributed cleaned ballast at the first outlet and a control housed in the cab for selectively positioning the ballast flow deflector.

11. The mobile ballast cleaning apparatus of claim 1, wherein the track is comprised of two rails fastened to ties defining cribs therebetween, the first ballast redistributing outlet and the second ballast redistributing outlet are arranged above one of said rails, and an additional ballast redistributing outlet is respectively transversely aligned with the first and with the second outlet, the additional outlets being arranged above the other rail whereby two parallel ones of said first and second layers of cleaned ballast may be formed.

* * * * *